United States Patent [19]

Veverka et al.

[11] Patent Number: 4,885,561

[45] Date of Patent: Dec. 5, 1989

[54] TRANSFORMER OVERLOAD AND FAULT PROTECTION APPARATUS

[75] Inventors: Edward F. Veverka, Racine; Stephen P. Hassler, Muskego, both of Wis.

[73] Assignee: Cooper Industries, Inc., Houston, Tex.

[21] Appl. No.: 271,288

[22] Filed: Nov. 15, 1988

[51] Int. Cl.[4] ..... H01H 85/02; H01H 71/10

[52] U.S. Cl. ..... 337/190; 337/178

[58] Field of Search ..... 337/190, 219, 157, 177, 337/178, 179, 173, 172, 171, 181, 182

[56] References Cited

U.S. PATENT DOCUMENTS

| | | | |
|---|---|---|---|
| 2,265,738 | 12/1941 | Matthews | 337/219 |
| 2,572,901 | 10/1951 | Yonkers . | |
| 2,704,795 | 3/1955 | Miller | 337/190 |
| 2,862,080 | 11/1958 | Yonkers | 337/177 |
| 2,915,605 | 12/1959 | Fahnoe . | |
| 3,041,426 | 6/1962 | Baker . | |
| 3,048,860 | 8/1962 | McCloud | 337/177 |
| 3,235,688 | 2/1966 | Fink et al. . | |
| 3,827,010 | 7/1974 | Cameron et al. . | |
| 3,958,205 | 5/1976 | Beard et al. | 337/178 |
| 4,011,537 | 3/1977 | Jackson Jr. et al. . | |
| 4,184,138 | 1/1980 | Beard et al. . | |
| 4,450,425 | 5/1984 | Manning . | |

*Primary Examiner*—H. Broome

*Attorney, Agent, or Firm*—Wigman & Cohen

[57] ABSTRACT

An overload and fault protector for a distribution transformer or the like is disclosed. A series-connected high range current-limiting fuse and a low range expulsion type fuse is provided with a transformer lead disconnect or ejection mechanism to insure a rapid, positive disconnect of the transformer or other power distribution circuit components. The ejection mechanism supports the transformer lead and completes the circuit to the fuse link assemblies. Upon separation of the fuse link, the ejection mechanism operates to quickly disconnect the transformer lead minimizing voltage stress on the fuse assembly and providing visible indication of a blown fuse.

16 Claims, 3 Drawing Sheets

TRANSFORMER OVERLOAD AND FAULT PROTECTION APPARATUS

FIELD OF THE INVENTION

The present invention relates to apparatus for protecting power distribution equipment, such as power transformers, from power surges which might damage such equipment. More particularly, the present invention is directed to improved fuse apparatus for ensuring quickdisconnect of a blown fusible link in an expulsion type low current fuse, including an improved load break fuse link flipper and transformer lead ejection mechanism.

BACKGROUND OF THE INVENTION

High range current-limiting fuses are known in the art, for example, as shown in U.S. Pat. Nos. 3,235,688 to Fink et al; 2,827,010 to Cameron et al; 4,011,537 to Jackson Jr. et al; 4,184,138 to Beard et al and 4,450,425 to Manning. Low range current-limiting fuses are known from U.S. Pat. Nos. 2,572,901 to Yonkers and 2,917,605 to Fahnoe. Other U.S. patents show the combination of high range and low range current-limiting fuse apparatus. In U.S. Pat. Nos. 3,235,688 to Fink et al and 3,827,010 to Cameron et al, the combination of high and low range current-limiting fuses with simple fuse link flippers are shown. None of the foregoing disclose a fuse link disconnect mechanism which positively disconnects and ejects the equipment or transformer lead per se. In the prior art apparatus, the transformer lead is typically permanently connected to the fuse link apparatus by a line terminal clamp or the like.

SUMMARY OF THE INVENTION

The present invention comprises a series-connected high range current-limiting fuse and a low range fuse of the expulsion type, the latter having an improved fuse link flipper and novel transformer lead drop or disconnect mechanism to ensure rapid, positive disconnect of the circuit to protect equipment such as pole mounted distribution tranformers.

A novel expulsion fuse link flipper and circuit lead ejector are arranged in a housing mounted to a tubular fuse holder containing one or more circuit overload devices, at least one of which is an expulsion fuse to enable protection of transformers and other power distribution circuit components.

The fuse link flipper element is pivoted within the housing and includes a latch pin or shaft. Located inside the housing is a current interchange device for restraining and contacting the free end of a conductor lead in circuit with the device to be protected. A pivoted conductor support urges the conductor free end firmly against the current interchange and completes the electrical circuit with the fuse link. The end of the conductor support is free to fall, i.e., pivot, to a downwardly open position when unrestrained. When the conductor support is closed to urge the conductor against the interchange as described, the fuse link flipper may be pivoted to a generally horizontal position such that the latch pin or shaft holds the conductor support locked in place against the conductor and current interchange. The fusible link is tensioned across and beneath the flipper and is securely fastened such that the flipper cannot pivot. The flipper mechanism may include a spring or other means to forcefully urge the flipper to its open position. In the operative position, the fusible link holds the flipper closed against the bias of the spring.

When the fusible link is subjected to an overload, it fuses or melts and separates thereby breaking the electrical circuit. To minimize arcing and ensure positive disconnect of the fuse circuit, the spring urges the now unrestrained flipper open which snaps the severed fusible link end free of the expulsion fuse. Simultaneously, the conductor support is unlatched and pivots to its open position so that the conductor drops free of the mechanism by gravity.

In an alternate embodiment of the invention a resilient spring ejector is arranged to exert a tensile bias on the fusible link or the fuse link leader. When the fusible link is subjected to an overload which causes it to fuse or melt, the spring ejector causes the fusible link to separate under tension and snaps the end of the fusible link free of the expulsion fuse housing or fuse holder.

BRIEF DESCRIPTION OF THE DRAWINGS

The invention will be better understood by reference to the drawing figures and the detailed description showing the principles of the invention, in which all reference numerals refer to the same elements, and in which.

DETAILED DESCRIPTION OF THE PREFERRED EMBODIMENT

Figure 3:
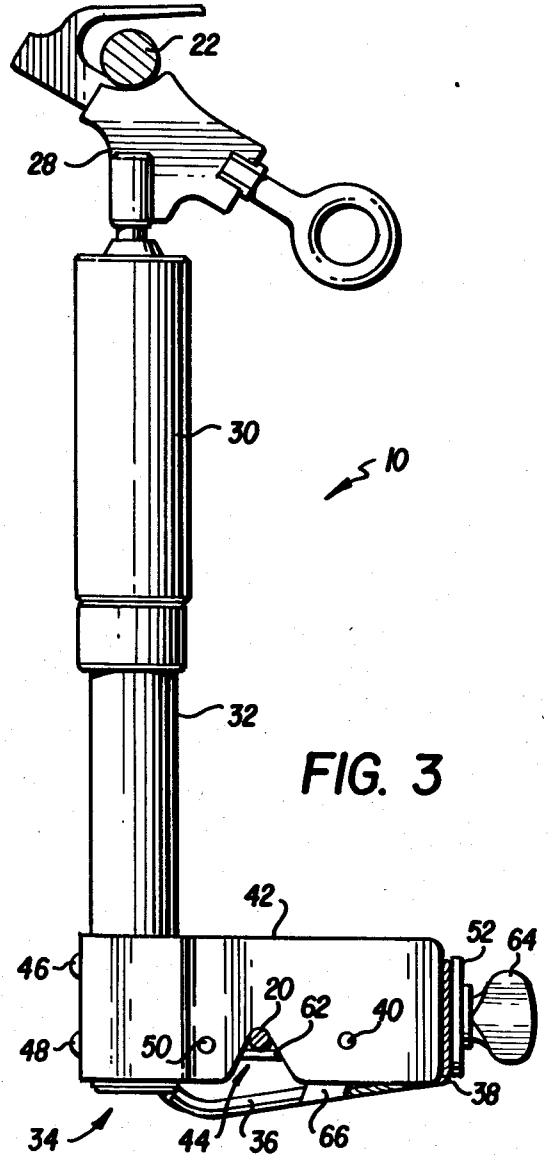
FIG. 3 shows a side elevation view of the inventive apparatus, including the fusible link flipper.
Figure 2:
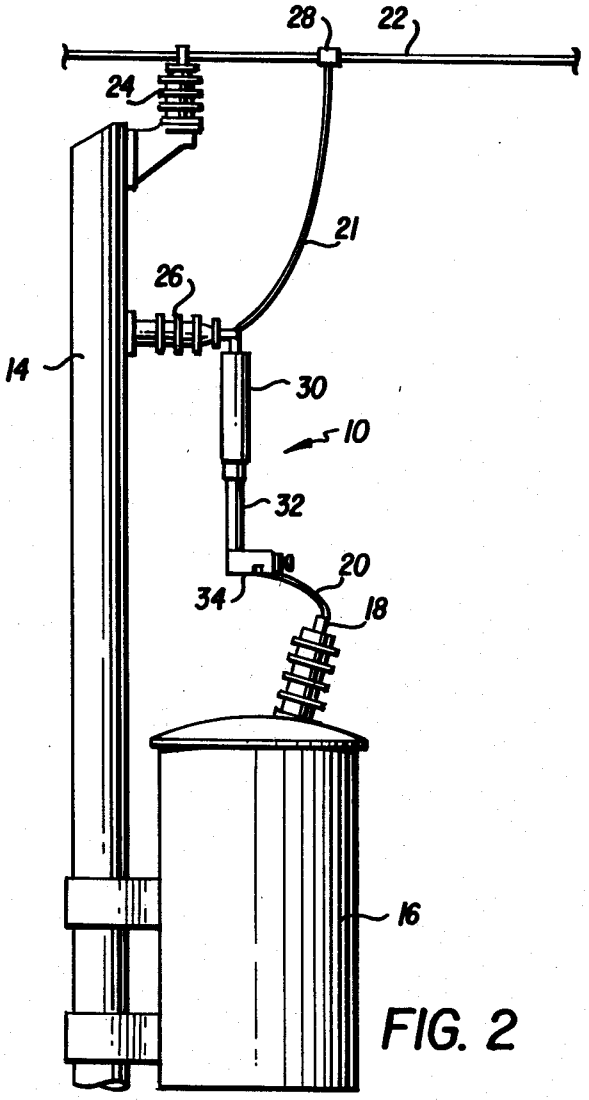
FIG. 2 shows the same invention in a similar, but alternate mounting scheme.
Figure 1:
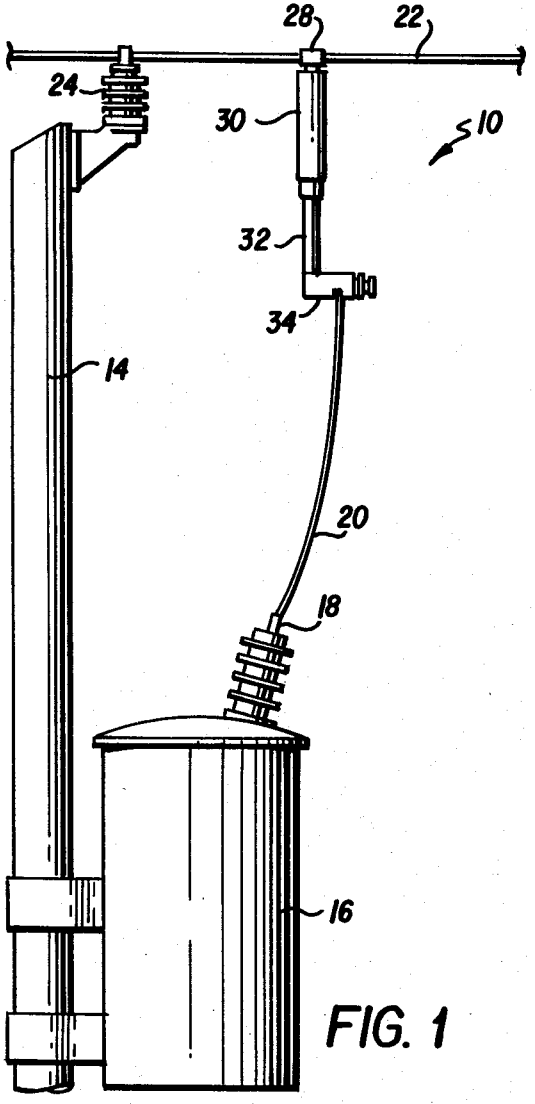
FIG. 1 shows in simplified form the invention mounted on a power pole.

In a typical distribution system including a high voltage distribution line running from pole to pole, transformers and other electrical equipment require protection from surges and overloads. Referring now to the drawings, FIG. 1 shows a power pole 14, a transformer 16 mounted on the pole, an insulator 24 supporting the high voltage line 22, a transformer terminal stud 18 connected to the transformer, and the improved fuse link apparatus 10 of the present invention. Fuse link 10 connects line 22 to transformer 16 via a hot line clamp 28, transformer lead 20 and terminal stud 18. Transformer 16 may be conveniently mounted in any number of other locations and configurations, such as platform mounting, without departing from the scope of the present invention. Similarly, the high range currentlimiting fuse may be omitted. The fuse link apparatus 10 also need not be connected directly to line 22 by a hot line clamp. In FIG. 2, for example, the fuse link apparatus 10 is shown connected to and supported from a pole-mounted insulator 26 and is connected to line 22 by a separate lead 21.

Figure 4:
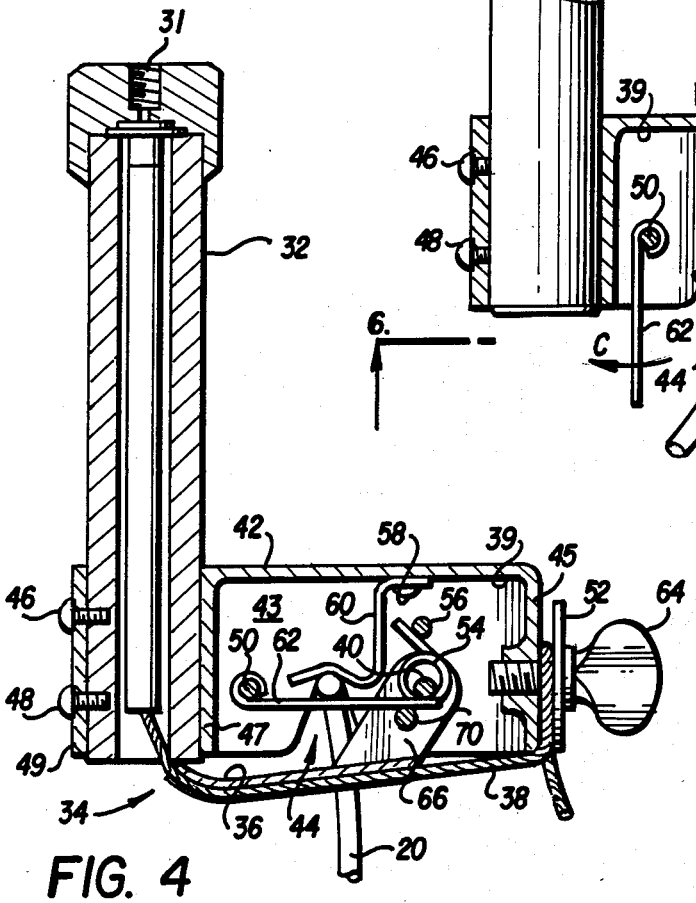
FIG. 4 is a cross-sectional side elevation view showing the fusible link flipper details.

The fuse link apparatus 10 is shown in more detail in FIGS. 3 through 6. A conventional hot line clamp 28 suspends the fuse link apparatus 10 from high voltage line 22. High range current limiting fuse 30 electrically connects low current range fuse 32 to the line and also supports the same by means of a threaded connection 31 (FIG. 4). Supported at the lower end of fuse 32 is the transformer lead disconnect and ejector mechanism 34 of the invention. Disconnect/ejector mechanism 34 includes a housing 42, which is preferably a conductive metal casting, such as copper or a copper alloy, and which is secured to the end of the tubular housing of fuse 32 by fasteners 46,48. Housing 42 includes a top panel 39, a pair of oppositely disposed vertical side walls 41,43 and vertical end walls 45,47 also joined to the top panel 39 to form a box-like enclosure open at the bottom. A cylindrical mounting sleeve 49 is integrally formed or cast with end wall 47 for receiving the lower end of the tubular holder of fuse 32. One or both of the side walls 41,43 are provided with an inverted, V-shaped notch 44 for receiving transformer lead 20.

Extending from the bottom end of fuse 32 is the expulsion fuse link leader 38, which is secured to the opposing end wall 45 of housing 42 by a contact washer 52 and is held firmly in electrical contact with the housing 42 by a fastener, such as threaded thumbscrew fastener 64. Extending between and fixed to the vertical side walls 41,43 of the housing 42 is a flipper axle or shaft 40 upon which a fuse link flipper 36 is pivotably supported. Coiled about flipper axle 40 is a spiral torsion spring 54, one end of which engages a pawl or spring stop 56, the other end of which engages a surface of the flipper 36 so as to torsionally urge the flipper downwardly against the fuse link leader 38 and toward its vertical position shown in FIG. 5. A conductor support plate 62 is pivotably mounted on a conductor support shaft or axle 50 which also extends between and is fixed to the vertical side walls 41,43 of the housing.

The elements of the present invention are shown most clearly in FIG. 4, which illustrates the arrangement of the flipper and disconnect elements associated with housing 42. A current interchange bracket 60, which may be constructed from any appropriate conductive material is secured to the inside top wall 39 of the housing 42 by a fastener 58. The bracket 60 may have a generally Z-shaped configuration to provide a resilient bias or force on the conductive connection with the transformer lead 20. A bend or curve is formed in the lower arm of the current interchange bracket (as shown) to hold and contact transformer lead 20, which is generally centered in notches 44 in the side walls of the housing.

In the embodiment described and shown herein, housing 42 is electrically conductive. If housing 42 is cast or otherwise fabricated of a non-conductive material, such as plastic, ceramic or the like, an electrically conductive path is required between transformer lead 20 and fuse link leader 38. Fuse link leader 38 extends from fuse 32 beneath flipper 36 and is secured to the housing end wall 45 as previously described. Flipper 36 includes two side arms 66,68 permitting radially offset suspension of the flipper below flipper axle 40. Between the flipper side arms extends a pin or shaft 70 or a pair of pawls on a single axis (or an equivalent structure) for engaging and supporting conductor support 62 in the closed, electrically active position of the flipper, as described below.

To place the flipper mechanism in the operative position, transformer lead 20 is placed in the notches 44 of the housing 42 and is guided upwardly into engagement with the lower bent arm of current interchange bracket 60. Conductor support plate 62 is then pivoted counterclockwise around axle 50 to hold the conductor against the lower arm, and flipper 36 is pivoted clockwise around axle 40 against the force of spring 54 until the pin 70 (or pawls) engages beneath and holds conductor support 62 against transformer lead 20, ensuring good electrical contact among the elements.

As the flipper 36 is pivoted from its fully open position (see FIG. 5) to its closed position, pin 70 engages and constrains conductor support plate 62 from releasing the transformer lead 20. The spring tension on flipper 36 exerted by spring 54 is such that immediately upon the separation of fuse link 38, flipper 36 snaps open downwardly and pin 70 releases conductor support 62 which, in turn, releases transformer lead 20, ensuring the circuit is completely and rapidly broken with a minimum of arcing. This is illustrated best in FIG. 5, where arrow A indicates the counterclockwise movement of flipper 36, arrow C indicates the clockwise movement of conductor support plate 62 and arrow B indicates the direction in which conductor 20 falls away from disconnect/ejector mechanism 34.

Figure 5:
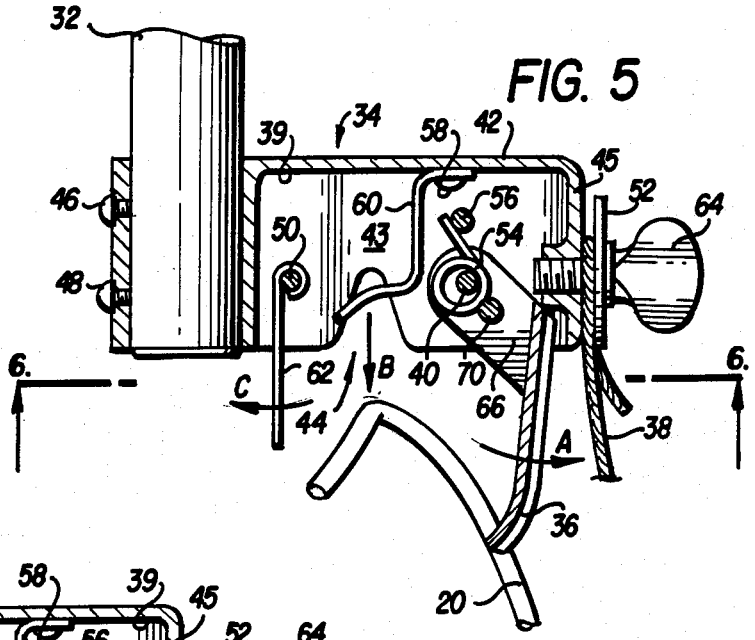
FIG. 5 is a cross-sectional side elevation showing the flipper in its released or "blown" state immediately following disconnect and release of the transformer lead.
Figure 6:
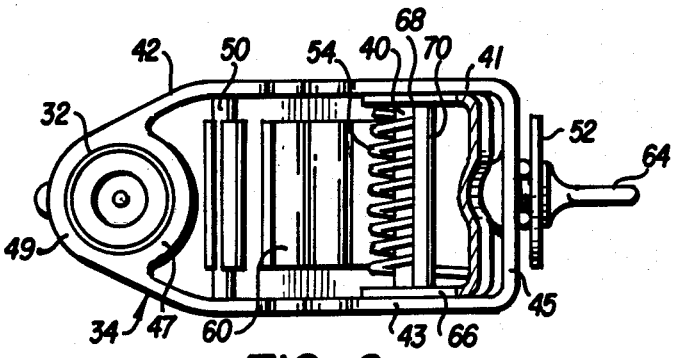
FIG. 6 is a bottom end plan view partly in section of the flipper mechanism taken along line 6—6 of FIG. 5.

In FIG. 5, fuse link leader 38 is shown in the blown condition withdrawn from tube 32, permitting the flipper 36 to drop, releasing transformer lead 20 and disconnecting the same from current interchange 60. It will be appreciated that by appropriate selection of the resiliency and shape of the lower arm of current interchange bracket 60 the transformer lead 20 may be forcefully ejected from the ejector apparatus 34, such force being in addition to the force of gravity causing lead 20 to drop away from ejector 34.

Figure 7:
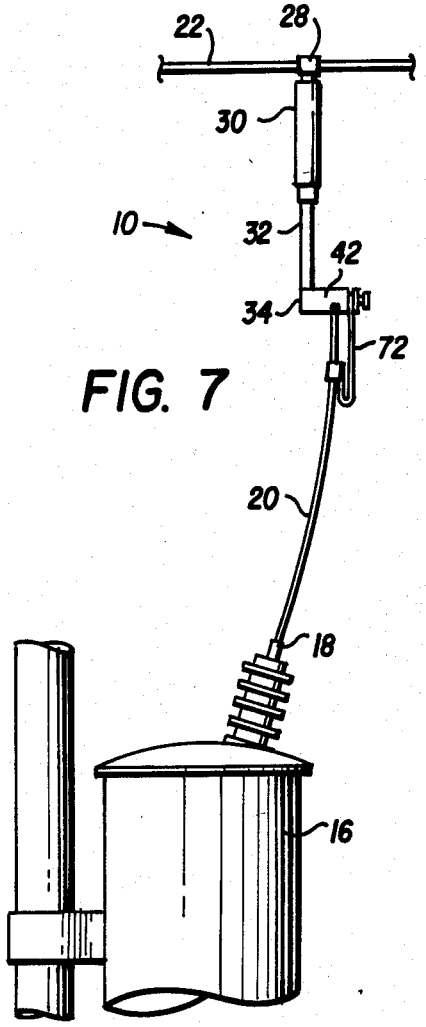
FIG. 7 illustrates an alternate embodiment in which the transformer lead is prevented from dropping completely free of the flipper.

There is shown in FIG. 7 an alternate embodiment of the invention in which an insulating lanyard 72 attached near the fuse end of the transformer lead 20 and to the housing 42 restricts the distance which transformer lead 20 can fall away from the fusing apparatus. The lanyard end may be secured to the other elements without departing from the scope of the present invention.

Figure 8:
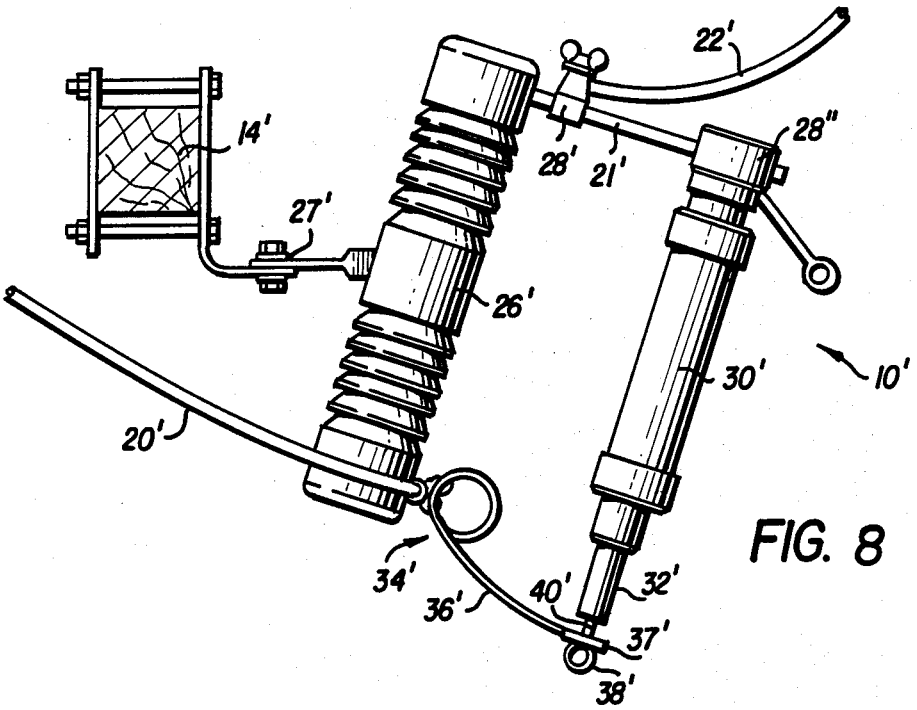
FIG. 8 is a side elevation view of another arrangement for quick-disconnection of a blown fuse link leader in the operative position.
Figure 9:
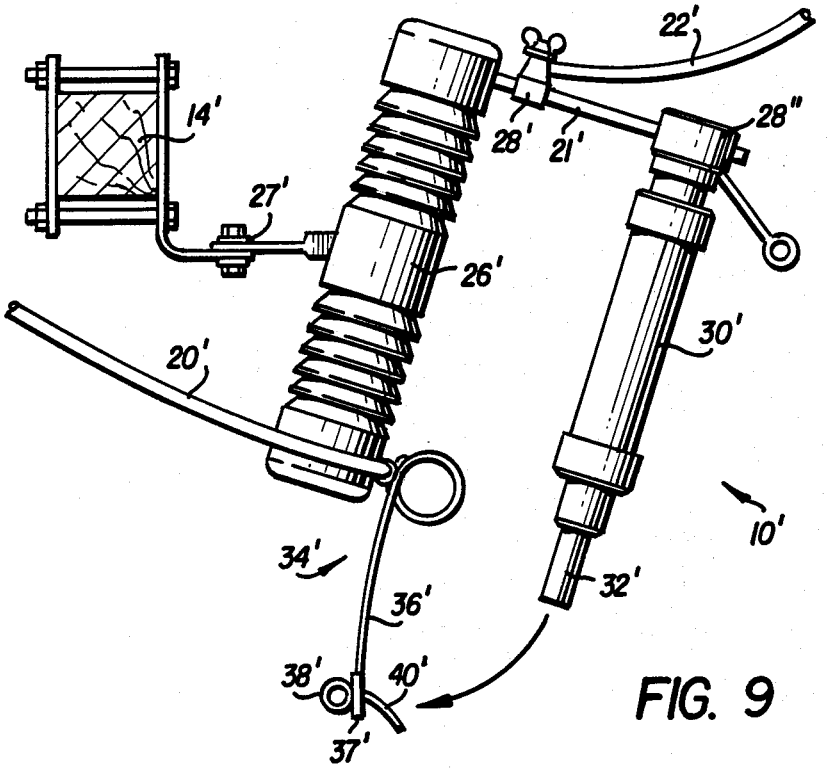
FIG. 9 is a side elevation view of the quick disconnection arrangement of FIG. 8 in the "blown" fuse condition.

An alternate embodiment of the invention is illustrated in FIGS. 8—9. In this embodiment, the fuse link apparatus 10′ comprising current limiting fuse 30′ and the refusable low current fuse 32′ is supported on an insulator 26′ which is, in turn, supported on a cross-arm 14′ by means of suitable brackets 27′. High voltage line 22′ is connected by a hot line clamp 28′ to a rigid conductor lead 21′ which is electrically connected to the high range current limiting fuse 30′ by a hot line connector 28″ similar to clamp 28 shown in FIG. 3. The load side or transformer lead 20′ is connected to the lower end of insulator 26′. A conductive fuse link spring ejector 34′ is fixedly mounted to the lower end of insulator 26′ and is electrically connected to lead 20′. The fuse link spring 34′ is preferably formed as a single coil or loop having one elongated arm 36′ with means 37′ at the free end thereof for releasably engaging an eyelet 38′ on the end of fuse link leader 40′. Such means 37′ may comprise, for example, a bifurcated free end or equivalent structure.

When the low current range expulsion fuse 32' is refused, the fuse link spring 34' is urged counterclockwise from the vertical position shown in FIG. 9 to the subtantially horizontal position shown in FIG. 8 and the eyelet 38' is engaged by the releasable engaging means 37' as shown in FIG. 8. In this position, the fuse link spring 34' exerts a downward tensile force on the low current fusible link leader 38' in proportion to the torsional force developed by the coil or loop of spring 34'.

In operation, when the fusible link of fuse 32' is subjected to an overload, it begins to fuse or melt. When the tensile force exerted by the fuse link spring 34' exceeds the tensile strength of the softened or melting fusible link, the latter part separates. The free end of the spring 34' then rotates or snaps clockwise to its nearly vertical position as shown in FIG. 9. The snap-action of the spring 34' ensures rapid and positive disconnect of the fuse circuit and a relatively small degree of arcing.

While the preferred embodiments of the present invention have been fully and completely set forth hereinabove, it will be apparent to those skilled in the art that many modifications to the invention may be made without departing from the true spirit and intended scope of the invention which is, accordingly, limited only by the following claims.

What is claimed is:

1. An overload and fault protector for a distribution transformer having an electrical lead end, comprising:

a fuse assembly having at least one fuse link adapted to separate upon an overload or fault condition, ejector means for electrically connecting and disconnecting the lead end to said fuse link, said ejector means including means for supporting the lead end in electrically conductive contact with said fuse link, said supporting means being responsive to the separation of said fuse link to release the lead end and to permit the lead end to fall away from its electrically conductive contact with said supporting means at least in part under the influence of gravity.

2. The overload and fault protector according to claim 1, wherein said supporting means further includes current interchange comprising a resilient bracket means, in electrically conductive contact with said lead end for forcefully ejecting said lead end from electrical contact with the current interchange.

3. The overload and fault protector according to claim 1 including an enclosure housing an expulsion fuse and an ejector means mounted to said expulsion fuse said housing including an electrically conductive path between said fuse link and said lead end.

4. The overload and fault protector according to claim 3 wherein said enclosure is made of an electrically conductive material.

5. The overload and fault protector according to claim 1 including an ejector means enclosure housing said supporting means which enclosure further includes conductor support plate means pivotably supported on said enclosure, fuse link flipper means pivotably supported on said enclosure in electrical contact with said lead end, said support plate means being pivotable toward said current interchange means to clamp said lead end against said current interchange means, said flipper means being pivotable into engagement with said support plate means to urge the flipper means into electrically conductive relation with the support plate means.

6. The overload and fault protector according to claim 5, including means resiliently biasing said flipper means for pivotable movement away from said support plate means, said fuse link holding said flipper means in engagement with said support plate means against the force of the biasing means.

7. The overload and fault protector according to claim 5 further including biasing means wherein said fuse link has a free end connected to said enclosure, said biasing means comprising a spiral spring.

8. The overload and fault protector according to claim 5 including a latch pin on said flipper means for engaging and urging said support plate means into electrically conductive contact against the lead end.

9. The overload and fault protector according to claim 1 wherein said fuse link comprises a high current interrupting fuse in series with a refusable low current expulsion fuse.

10. A fuse link flipper and lead ejector for use in combination with a fuse having a fuse link free end extending therefrom, comprising:

housing means for supporting said fuse link flipper and lead ejector, said housing including mounting means adapted for attachment to said fuse;

an electrical circuit conductor lead having a relatively free end;

conductor support plate having a first end pivotably mounted on a horizontal first axle secured to said housing, and a second end, said support plate means being pivotable through an arc normal to said axle from a first position to a second position;

current interchange means secured to said housing for contacting said electrical conductor;

fuse link flipper means for rapidly separating said fuse link, said flipper means being substantially horizontal in a first position, said fuse link flipper means including a pair of upwardly extending support arms pivotably mounted to said housing by a horizontal second axle, and latch pin means secured between said support arms, said flipper having a generally vertical second position;

means for urging said fuse link flipper means from said first position to said second position; and fuse link end restraint means for securing the free end of said fuse link, whereby said conductor lead is held against the current interchange means by the conductor support plate means, the second end of which is supported by the latch pin means when the flipper .means is in its first position, the fuse link being drawn across the lower side of said flipper means and secured by said fuse link end restraint means.

11. A fuse link flipper and lead ejector according to claim 10 wherein said first position of said electrical conductor support plate means is substantially horizontal.

12. A fuse link flipper and lead ejector according to claim 10 wherein said electrical conductor support plate means is an electrically conductive material.

13. A fuse link flipper and lead ejector according to claim 10 for use with an overhead power line including hot line clamp means capable of alternate attachment to and removal from an overhead power line for making an electrical connection between said fuse and said overhead power line.

14. An overload and fault protector for a distribution transformer having a lead end, comprising:

a fuse having a fuse link adapted to separate upon an overload or fault location;

ejector means for electrically connecting and disconnecting the transformer lead to said fuse link, said ejector means including resilient spring means responsive to the separation of said fuse link for disconnecting the electrical connection between the transformer lead and the fuse link; and enclosure means mounted to said fuse substantially housing said ejector means.

15. The overload and fault protector according to claim 14, wherein said resilient means comprises a fuse link spring electrically and mechanically connected to the fuse link.

16. The overload and fault protector according to claim 15, wherein said spring comprises at least one torsional loop connected to the fuse link, said spring in its operative position being arranged to apply a tensile force to the fuse link whereby upon separation of said fuse link the tensile force applied by said spring quickly disconnects a separated portion of said fuse link from the remaining portion of said fuse link to minimize voltage stress on the fuse and to provide a visible indication of a blown fuse.

* * * * *